US008454207B2

(12) United States Patent
Thomas

(10) Patent No.: US 8,454,207 B2
(45) Date of Patent: Jun. 4, 2013

(54) MULTI-LAMP FLUORESCENT LIGHTING FIXTURE APPARATUS AND WIRING METHOD

(75) Inventor: Edward John Thomas, Streetsboro, OH (US)

(73) Assignee: General Electric Company, Schenectady, NY (US)

( * ) Notice: Subject to any disclaimer, the term of this patent is extended or adjusted under 35 U.S.C. 154(b) by 476 days.

(21) Appl. No.: 12/792,839

(22) Filed: Jun. 3, 2010

(65) Prior Publication Data

US 2011/0299291 A1 Dec. 8, 2011

(51) Int. Cl.
*F21V 19/00* (2006.01)
*F21V 21/00* (2006.01)

(52) U.S. Cl.
USPC ..... 362/382; 362/219; 29/825

(58) Field of Classification Search
USPC ..... 362/217.09, 219, 382, 217.08; 29/825, 29/529.1
See application file for complete search history.

(56) References Cited

U.S. PATENT DOCUMENTS

| | | | | |
|---|---|---|---|---|
| 4,185,233 | A * | 1/1980 | Riesland et al. | 315/276 |
| RE31,970 | E * | 8/1985 | Riesland et al. | 315/276 |
| 5,350,316 | A * | 9/1994 | Van Wagener et al. | 439/460 |
| 5,654,609 | A * | 8/1997 | Smallwood et al. | 315/56 |
| 7,380,957 | B2 * | 6/2008 | Lanczy | 362/219 |
| 2005/0201088 | A1 * | 9/2005 | Stach et al. | 362/225 |

* cited by examiner

*Primary Examiner* — Mariceli Santiago
*Assistant Examiner* — Glenn Zimmerman
(74) *Attorney, Agent, or Firm* — Fay Sharpe LLP

(57) ABSTRACT

A fluorescent lamp fixture apparatus (100) and wiring method (200) are described in which a ballast (B) is located near the fixture center (110*c*) and high frequency high potential wires (HFW1-HFW4) extending from the ballast are directly connected to inner lampholders (LH1*a*, LH2*a*, LH3*a*, LH4*a*), with low frequency low potential wiring runs (E1LFRUN, E2LFRUN) extending toward the fixture ends (FE1, FE2) for connection to outer lampholders (LH1*b*-LH4*b*) to mitigate capacitive and inductive coupling effects in the fixture.

19 Claims, 4 Drawing Sheets

MULTI-LAMP FLUORESCENT LIGHTING FIXTURE APPARATUS AND WIRING METHOD

BACKGROUND OF THE DISCLOSURE

Fluorescent lighting fixtures are used to house and support fluorescent lamps and associated ballast or driver circuitry, lampholders and wiring. In multi-lamp fixtures, it is desirable to avoid or mitigate lamp luminous imbalance, particular in deep dimming operation to maintain uniform fixture appearance. In addition, it is desirable to avoid uneven and/or excessive heating and voltage drops in fixture wiring and lampholder jumper contacts. Series connection of lamps in multi-lamp fixtures may avoid certain of these problems, but failure of a single lamp can cause the remaining lamps in a fixture to extinguish. Parallel operation may avoid this latter problem, but requires that each ballast driver output provide the same current to its respective lamp load to achieve luminous uniformity, and ensuring uniform current flow through each lamp is more difficult with a parallel operation system, particularly when the ballast and lampholders are connected using conventional fixture wiring techniques.

SUMMARY OF THE DISCLOSURE

The present disclosure provides multi-lamp fluorescent lighting fixture apparatus and wiring methods in which a ballast is positioned at or near the center of the fixture structure to minimize lengths and interaction of high frequency high potential lamp leads. This approach serves to reduce or minimize the effect of the undesired capacitive and inductive coupling of high frequency high potential lamp leads running near each other and near the grounded metallic fixture.

A fluorescent lamp fixture apparatus is provided, including a fixture structure with first and second ends, a ballast, and inner and outer lampholders, with inner lampholders near the fixture center and outer lampholders near the fixture ends. The ballast has a first ballast end proximate the fixture center and a plurality of high frequency high potential wires extend from the first ballast end, with the high frequency high potential wires connected directly to the inner lampholders.

The ballast in certain embodiments includes low frequency low potential wires extending from the ballast housing, and the apparatus comprises a first low frequency low potential wiring run including at least two wires connected to the low frequency low potential wires and extending toward the first fixture end for connection to the first set of outer lampholders proximate the first fixture end. In addition, a second low frequency low potential wiring run is provided, including at least two wires connected to the low frequency low potential wires and extending toward the second fixture end, which are connected to the second set of outer lampholders proximate the second fixture end. The apparatus in certain embodiments includes multi-tap connectors connected to the low frequency low potential wires proximate the fixture center, with the wires of the first and second low frequency low potential wiring runs connected to the multi-tap connectors and extending toward the respective fixture ends. In various embodiments, moreover, the low frequency low potential wiring runs are of generally equal length.

In certain embodiments, the high frequency high potential wires are connected to lampholders for parallel connection of the fluorescent tube lamps. In some embodiments, the high frequency high potential wires are connected to lampholders for series connection of at least two of the lamps.

A method is provided for wiring a fluorescent lamp fixture apparatus to drive at least one pair of fluorescent tube lamps. The method includes locating a first end of a ballast proximate the center of a fixture, connecting high frequency high potential wires extending from the first ballast end directly to inner lampholders proximate the fixture center, and connecting low frequency low potential wires extending from the ballast housing to outer lampholders proximate the fixture ends. In certain embodiments, connection of the low frequency low potential wires includes creating first and second low frequency low potential wiring runs individually connected to the low frequency low potential wires, the low frequency low potential wiring runs individually extending toward corresponding fixture ends, and connecting wires of the first and second low frequency low potential wiring runs to the outer lampholders near the fixture ends, where the low frequency low potential wires may be connected to the low frequency low potential runs via multi-tap connectors in some embodiments. In certain embodiments, moreover, the creation of the low frequency low potential wiring runs includes making the first and second low frequency low potential wiring runs of approximately equal length.

BRIEF DESCRIPTION OF THE DRAWINGS

One or more exemplary embodiments are set forth in the following, detailed description and the drawings, in which.

DETAILED DESCRIPTION OF THE PREFERRED EMBODIMENTS

Figure 1:
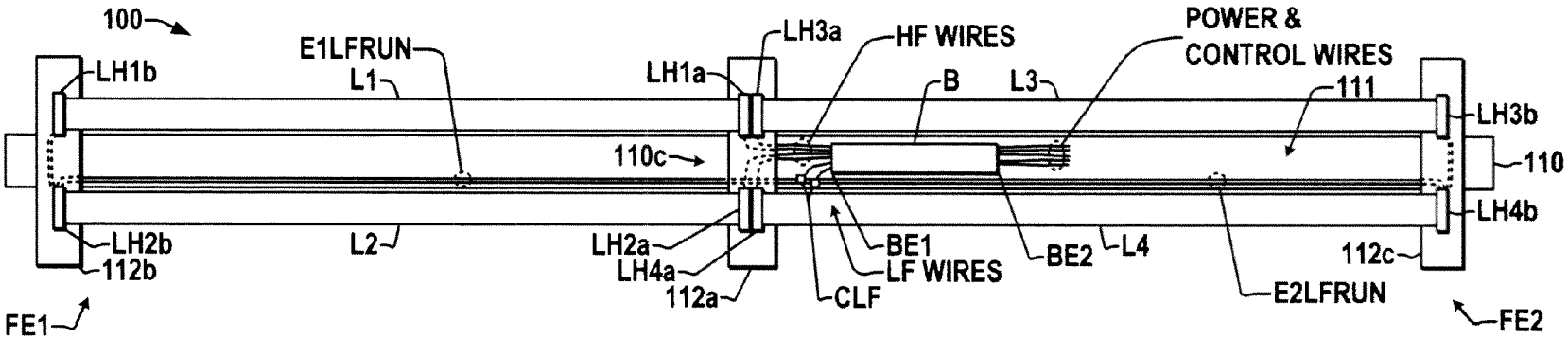
FIG. 1 is a partial bottom plan view illustrating a fluorescent lamp fixture apparatus with a ballast located near the fixture center and high frequency high potential wires connected directly from the ballast to inner lampholders and with low frequency low potential wiring runs extending toward the fixture ends for connection to outer lampholders.

Referring now to the drawings, like reference numerals are used in the figures to refer to like elements throughout, and the various features are not necessarily drawn to scale. The present disclosure relates to fluorescent lighting fixtures and fixture wiring techniques in which a ballast is positioned within the fluorescent fixture so as to minimize lengths of and grouping of specific lamp leads together in order to reduce or minimize undesired capacitive and inductive coupling effects associated with prior implementations in which high frequency lamp leads were routed near each other and near the grounded metallic fixture. The proposed apparatus and methods may be employed to also reduce the current carrying requirements of the lampholder jumper contacts and to create a uniform fixture appearance by minimizing the lamp luminous imbalance while providing a more uniform return side cathode heating, where these advantages may be accomplished in certain embodiments along with the benefits parallel operation dimming ballast designs.

An exemplary fluorescent lamp fixture apparatus 100 is shown in FIGS. 1-4 in which a ballast B is located near a center portion 110*c* of a fixture housing 110 (FIGS. 1 and 2), with high frequency high potential wires HFW1-HFW4 extending from the ballast being directly connected to inner lampholders LH1*a*, LH2*a*, LH3*a*, LH4*a* so as to mitigate capacitive and inductive coupling effects in the fixture. In certain embodiments, the length of the high frequency high potential wires HFW1-HFW4 from the first end BE1 of the ballast B to the inner lampholders LH1*a*-LH4*a* is about 16 inches or less. In addition, low frequency low potential wiring runs E1LFRUN and E2LFRUN extend from the fixture center 110*c* toward corresponding longitudinal fixture ends FE1 and FE2 for connection to outer lampholders LH1*b*-LH4*b*. As used herein, high frequency high potential wires HFW are those driven ballast output wires or leads carrying drive currents and voltages for powering fluorescent lamp tubes L excluding return lines LFW, and are distinct from power wiring by which input power is provided to a ballast B and are also distinct from control wires by which dimming or other control inputs (analog or digital) are provided to control operation of a ballast B. The high frequency high potential wires, moreover, are at a high potential relative to ground, such as several hundred volts in certain embodiments, and at least about 100 volts in certain embodiments. The low frequency low potential wires or leads LFW referred to herein are return lines for connection to lampholders, where the high frequency high potential wires HFW are generally of higher voltage than the low frequency low potential wires LFW relative to the potential of the grounded metal fixture structure 110, such as less than about 100 volts in certain embodiments.

Figure 2:
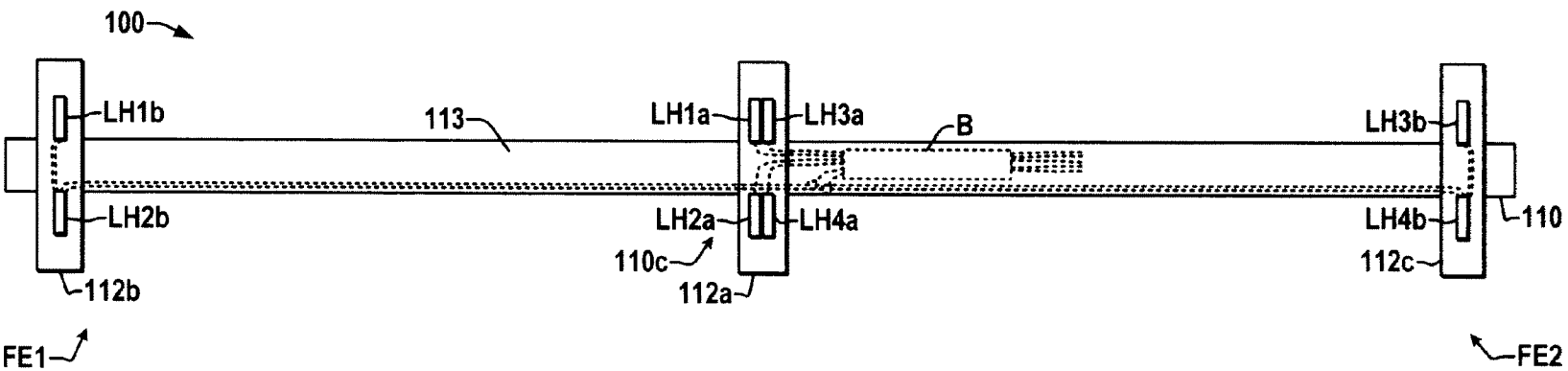
FIG. 2 is a partial bottom plan view illustrating the lamp fixture apparatus with lamps removed and a wiring channel cover installed.
Figure 3:
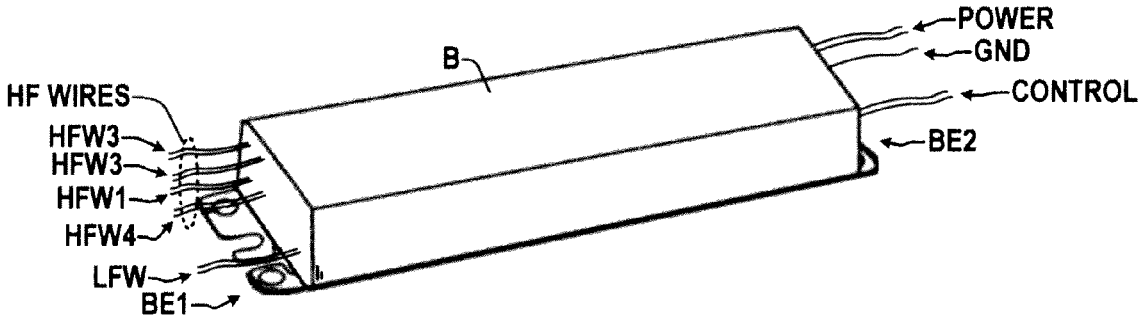
FIG. 3 is a perspective view illustrating an exemplary dimming ballast in the fixture apparatus of FIGS. 1 and 2 including high frequency high potential wires extending from a first ballast end and with power and dimming control wires extending from a second end.

In one embodiment, the fixture structure 110 is an LSI Lighting Systems Model WM 232 Type 22 LSI 277 sold by LSI Industries, Inc of Cincinnati, Ohio, for driving four bipin fluorescent tube lamps L1-L4 in a 2×2 using s lampholder configuration including lampholders LH of type BJB Model 26292, although other fixture structures 110 and lampholder LH can be used. As shown in FIG. 1, the fixture apparatus 100 includes the fixture structure 110 which has first and second longitudinal fixture ends FE1 and FE2, respectively, as well as a fixture center 110*c* approximately midway between the fixture ends FE1 and FE2. In this embodiment, four inner lampholders LH1*a*, LH2*a*, LH3*a*, and LH4*a* are mounted to the fixture structure 110 near or proximate to the fixture center 110*c*, and four outer lampholders LH1*b*, LH2*b*, LH3*b*, and LH4*b* are provided near the fixture ends FE1 and FE2, including a first set of outer lampholders LH1*b* and LH2*b* proximate the first fixture end FE1, and a second set of outer lampholders LH3*b* and LH4*b* proximate the second fixture end FE2. The fixture housing 110 in this example provides a generally rectangular wiring channel 111 in which the ballast B is mounted (FIG. 1) and through which the various ballast wires are routed, with a cover 113 used to cover the wiring channel when wiring connection is completed, as shown in FIG. 2.

The ballast B in the illustrated example is a parallel drive ballast for driving four lamps L1-L4 in a parallel configuration, and the ballast B provide controlled dimming according to dimming control leads using power provided from a line supply. The ballast B includes a generally rectangular ballast housing with a first ballast end BE1 proximate the fixture center 110*c* and a second ballast end BE2. A group of four high frequency high potential wire pairs HFW1-HFW4 extend from the first ballast end BE1 located within about 16 inches or less from the fixture center 110*c*, and the wires HFW1-HFW4 are connected directly to the inner lampholders LH1*a*, LH2*a*, LH3*a*, and LH4*a* near the fixture center 110*c* as shown in FIG. 1. In one implementation, the ballast B is bolted into the wiring channel of the fixture enclosure 110, with the lampholders LH mounted to cross members 112*a*-112*c*, where the wires HFW are inserted into spring loaded clamp connectors (not shown) of the inner lampholders LH. The wires HFW and LFW in this embodiment exit the ballast housing at about ¾ inch above the grounded metal plane of the enclosure channel. In one implementation, the high frequency high potential wires HFW may be pre-cut to a certain length and may be stripped to remove insulation near the wire ends, and are then routed generally straight up from the ballast B and then bent to make a 90° bend for connection directly into respective inner lampholders LH1*a*-LH4*a* so as to minimize the adjacency of the wires HFW with the grounded structure 110 and to also minimize the high frequency high potential wire lengths.

The ballast B also includes a pair of low frequency low potential return wires LFW1 and LFW2 that extend from the first end BE1 of the ballast housing B, which are connected to outer lampholders LH1*b*-LH4*b* proximate the fixture ends FE1 and FE2 via first and second low frequency low potential wiring runs E1LFRUN and E2LFRUN, each including two wires connected to the low frequency low potential wires LFW1 and LFW2 and extending toward the respective first and second fixture ends FE1 and FE2. The low frequency low potential runs E1LFRUN and E2LFRUN are connected to the outer lampholders LH1*b*-LH4*b* proximate the fixture ends FE1 and FE2. In certain embodiments, low frequency low potential runs E1LFRUN and E2LFRUN are individually connected to a first outer lamp holder at the respective fixture ends, and two wires are used to jumpered to the second lampholder at that end. This arrangement eliminates the previous daisy-chained routing and the associated voltage drop heating non-uniformity problems associated with the series wiring.

In the illustrated embodiment, moreover, two multi-tap connectors CLF are connected to the low frequency low potential wires LFW1, LFW2 near the fixture center 110*c*, and the wires of the low frequency low potential wiring runs E1LFRUN and E2LFRUN are connected to the multi-tap connectors CLF, with the first and second low frequency low potential wiring runs E1LFRUN, E2LFRUN being of approximately equal length in certain embodiments.

Figure 4:
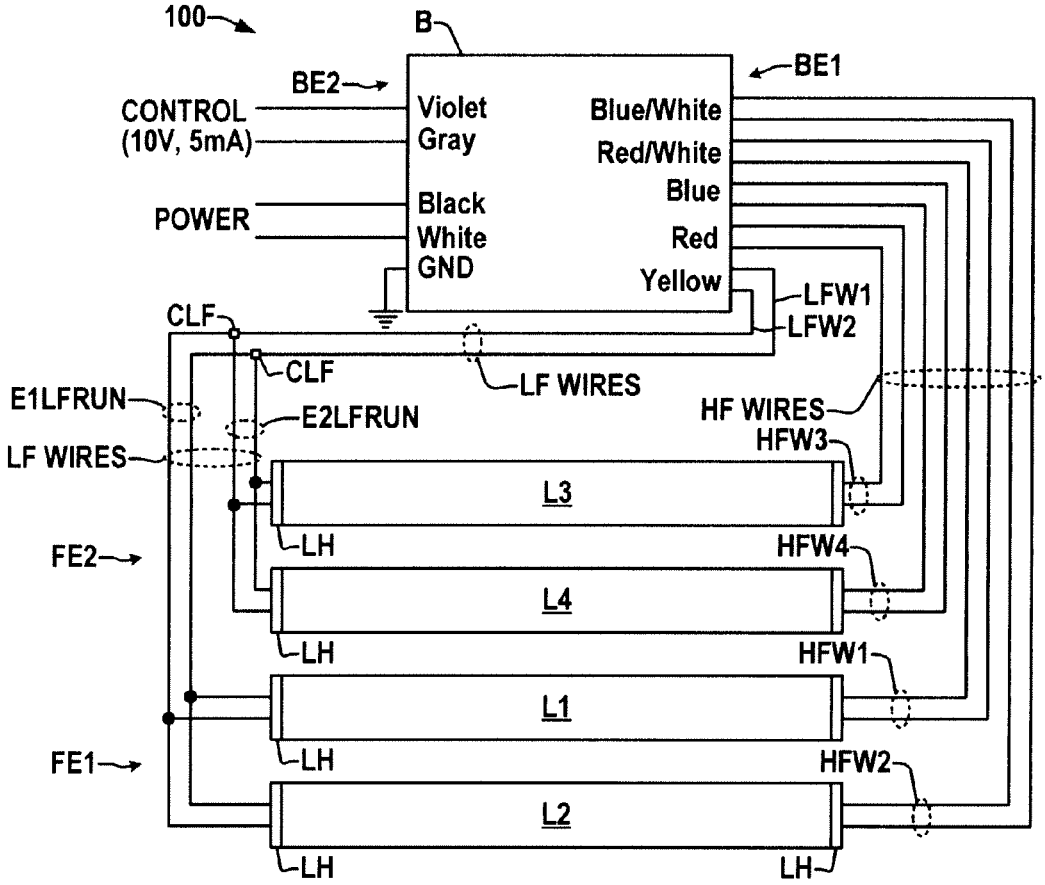
FIG. 4 is a schematic diagram illustrating interconnection of four lamps in parallel in the fixture apparatus of FIGS. 1 and 2.

In the embodiment of FIGS. 1-4, the high frequency wires HFW1-HFW4 are connected to the lampholders LH for parallel connection of the fluorescent tube lamps L1-L4 as shown in FIG. 4. In this configuration, these low frequency low potential wires of E1LFRUN and E2LFRUN are at low frequency and terminate at an internal electrolytic capacitor system ground, and the high frequency high potential wires HFW1-HFW4 (on the right side of FIG. 4) are driven at high frequency and come from the high frequency high voltage bus of the ballast B.

The above described techniques can be employed in alternate embodiments (not shown) having only a single pair of lamps (two inner lampholders LH and two outer lampholders LH) per fixture, in which shorter high frequency high potential wires or leads terminate to the ballast B proximate the fixture center 110*c*, and the low frequency low potential wires terminate at the fixture ends FE.

Figure 5:
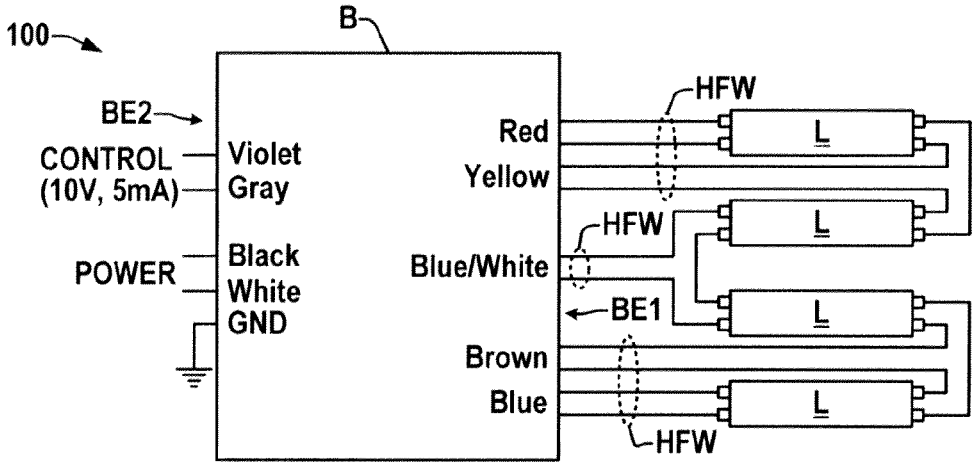
FIG. 5 is a schematic diagram illustrating another embodiment in which four lamps are connected in series.

Another possible embodiment is shown in FIG. 5, with the high frequency high potential wires HFW1-HFW4 connected to the lampholders LH for series connection of at least two of the fluorescent tube lamps L. In this case, all of the lamp wires are at high frequency and high potential with respect to earth ground, where the differential voltage between the two brown or yellow wires may be 6-7 volts, but common voltage to earth ground is still several hundred volts, This ballast operates in a series string, where the discharge energy originates from the red ballast wire leads and flows sequentially through all four lamps L to the blue ballast wires.

Figure 6:
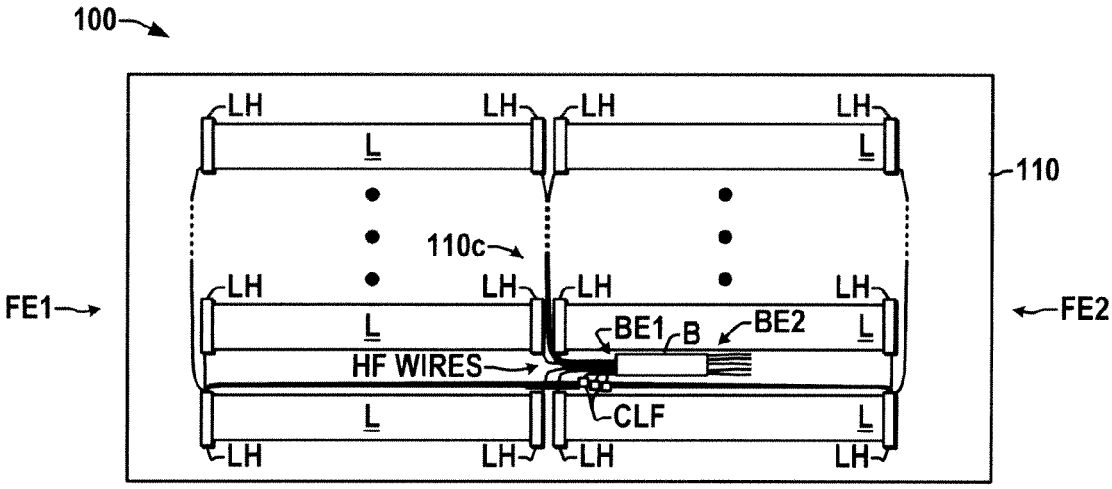
FIG. 6 is a simplified partial bottom plan view illustrating another lamp fixture apparatus with more than two pairs of lamps.

FIG. 6 shows another possible embodiment, in which one or more pairs of lamps L may be accommodated via corresponding pairs of inner and outer lampholders LH, with the high frequency high potential wires HFW extending from the first ballast end BE1 and being connected directly to the inner lampholders LH to mitigate capacitive and inductive coupling effects in the fixture. In this embodiment, moreover, the low frequency low potential wiring runs extend toward the fixture ends FE1, FE2 for connection to outer lampholders to provide uniform heating without excessive voltage drops in the return circuit paths.

Figure 7:
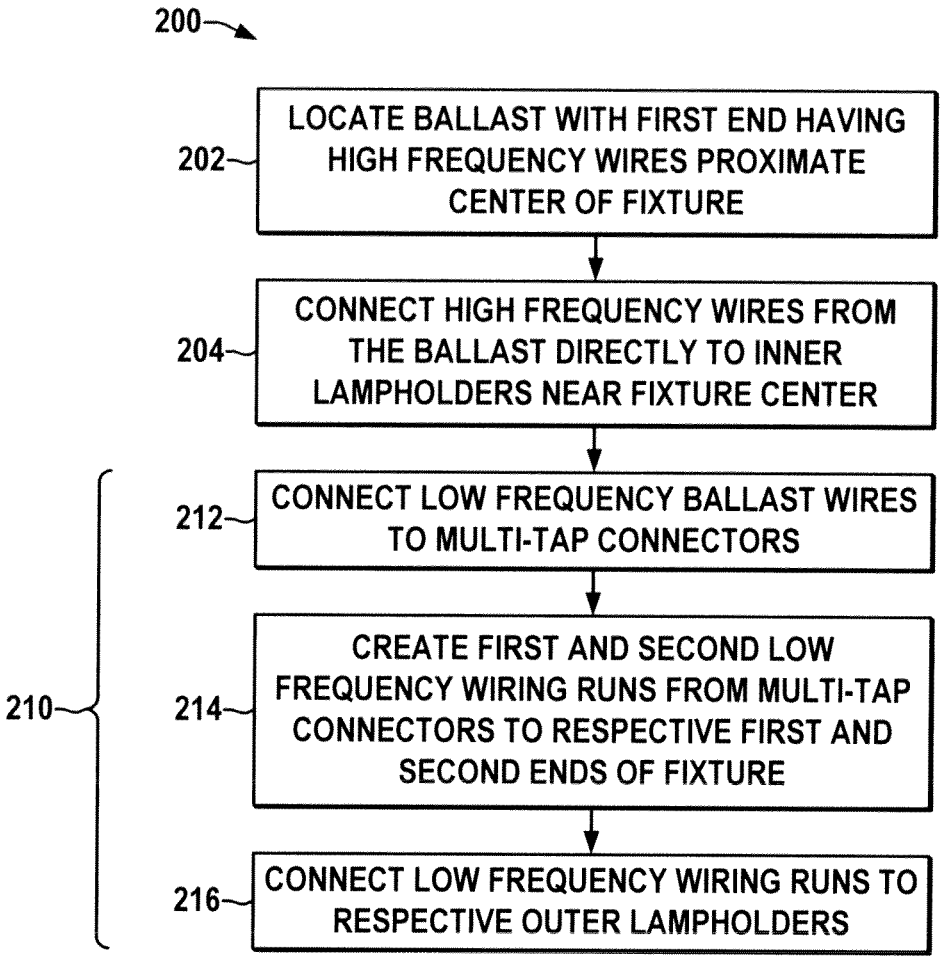
FIG. 7 is a flow diagram illustrating an exemplary method for wiring a fluorescent lamp fixture apparatus to drive one or more pairs of fluorescent tube lamps.

FIG. 7 illustrates an exemplary method 200 for wiring a fluorescent lamp fixture apparatus 100 to drive one or more pairs of fluorescent tube lamps L. Although the method 200 is illustrated and described hereinafter as a series of acts or events, the various methods of the invention are not limited by the illustrated ordering of such acts or events. In this regard, some acts or events may occur in different order and/or concurrently with other acts or events apart from those illustrated and described herein and not all illustrated steps may be required to implement a process or method in accordance with the present disclosure.

At 202, the ballast B is located with a first end BE1 having high frequency high potential wires HFW proximate the center 110*c* of the fixture 110. At 202, a plurality of high frequency high potential wires HFW1-HFW4 are connected from the first ballast end BE1 directly to inner lampholders LH1*a*-LH4*a* proximate the fixture center 110*c*.

At 210, low frequency low potential wires LFW1, LFW2 are connected from the ballast housing B to outer lampholders LH1*b*-LH4*b* proximate the fixture ends FE1 and FE2. In one embodiment, the connection of the low frequency low potential wires LFW at 210 includes connecting two or more multi-tap connectors CLF to the low frequency low potential wires LFW1, LFW2 proximate the fixture center 110*c* at 212. At 214 first and second low frequency low potential wiring runs E1LFRUN and E2LFRUN are created. In the illustrated examples, each low frequency low potential wiring run E1LFRUN and E2LFRUN includes two wires connected to the low frequency and low potential wires LFW1 and LFW2 via the connectors CLF and extending toward the corresponding fixture ends FE1 and FE2, where the first and second low frequency low potential wiring runs E1LFRUN and E2LFRUN are approximately equal in length (e.g., within about 3-4 inches of being equal) in certain embodiments. At 216, the wires of the first and second low frequency low potential wiring runs E1LFRUN and E2LFRUN are connected to the outer lampholders LH1*b*-LH4*b* proximate the fixture ends FE1, FE2.

By these fixture wiring techniques, the "hot" or high frequency and high potential wire length can be reduced or minimized and made generally uniformly spaced and away from the grounded metal of the fixture housing 110 to avoid or reduce capacitive and inductive coupling effects in the fixture. Having the dual set of generally equal length low frequency return wires can reduce or minimize the effect of heating voltage drops across multiple "daisy-chained" lampholders as was the case using prior wiring techniques in which one set of return leads was attached to all 4 outer lampholders. The use of bifurcated low frequency low potential runs reduces the voltage drops cause by daisy-chaining contact resistances of successive lampholders and jumpers and the associated heating voltage, and equally divides the current load. The disclosed method 200 and apparatus 100 thus provide two low frequency low potential return paths in which the low frequency low potential wires are jumpered only once in certain embodiments, whereby there are fewer voltage drop connections, and consequently the cathode heating voltages will be more uniform than in the conventional case.

The above examples are merely illustrative of several possible embodiments of various aspects of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof which performs the specified function of the described component (i.e., that is functionally equivalent), even though not structurally equivalent to the disclosed structure which performs the function in the illustrated implementations of the disclosure. In addition, although a particular feature of the disclosure may have been illustrated and/or described with respect to only one of several implementations, such feature may be combined with one or more other features of the other implementations as may be desired and advantageous for any given or particular application. Furthermore, references to singular components or items are intended, unless otherwise specified, to encompass two or more such components or items. Also, to the extent that the terms "including", "includes", "having", "has", "with", or variants thereof are used in the detailed description and/or in the claims, such terms are intended to be inclusive in a manner similar to the term "comprising". The invention has been described with reference to the preferred embodiments. Modifications and alterations will occur to others upon reading and understanding the preceding detailed description. It is intended that the invention be construed as including all such modifications and alterations.

The following is claimed:

1. A fluorescent lamp fixture apparatus for one or more pairs of fluorescent tube lamps, comprising:

a fixture structure having first and second longitudinal fixture ends and a fixture center midway between the fixture ends;

at least two inner lampholders proximate the fixture center;

at least two outer lampholders, including a first set of at least two outer lampholders proximate the first fixture end, and a second set of at least two outer lampholders proximate the second fixture end; and a ballast, comprising:

a ballast housing with a first ballast end proximate the fixture center and a second ballast end, and a plurality of high frequency high potential wires extending from the first ballast end, the high frequency high potential wires connected directly to the inner lampholders.

2. The fluorescent lamp fixture apparatus of claim 1, the ballast further comprising a plurality of low frequency low potential wires extending from the ballast housing; and the lamp fixture apparatus further comprising:

a first low frequency low potential wiring run including at least two wires connected to the low frequency low potential wires and extending toward the first fixture end and connected to the first set of outer lampholders proximate the first fixture end; and a second low frequency low potential wiring run including at least two wires connected to the low frequency low potential wires and extending toward the second fixture end and connected to the second set of outer lampholders proximate the second fixture end.

3. The fluorescent lamp fixture apparatus of claim 2, further comprising:

at least two multi-tap connectors connected to the low frequency low potential wires proximate the fixture center;

the wires of the first low frequency low potential wiring run being connected to the multi-tap connectors and extending from the multi-tap connectors toward the first fixture end and connected to the first set of outer lampholders proximate the first longitudinal fixture end; and the wires of the second low frequency low potential wiring run being connected to the multi-tap connectors and extending from the multi-tap connectors toward the second fixture end and connected to the second set of outer lampholders proximate the second longitudinal fixture end.

4. The fluorescent lamp fixture apparatus of claim 3, where the first and second low frequency low potential wiring runs are of approximately equal length.

5. The fluorescent lamp fixture apparatus of claim 4, where the high frequency high potential wires are connected to lampholders for parallel connection of the fluorescent tube lamps.

6. The fluorescent lamp fixture apparatus of claim 4, where the high frequency high potential wires are connected to lampholders for series connection of all fluorescent tube lamps.

7. The fluorescent lamp fixture apparatus of claim 3, where the high frequency high potential wires are connected to lampholders for parallel connection of the fluorescent tube lamps.

8. The fluorescent lamp fixture apparatus of claim 2, where the first and second low frequency low potential wiring runs are of approximately equal length.

9. The fluorescent lamp fixture apparatus of claim 2, where the high frequency high potential wires are connected to lampholders for parallel connection of the fluorescent tube lamps.

10. The fluorescent lamp fixture apparatus of claim 1, where first and second low frequency low potential wiring runs are of approximately equal length.

11. The fluorescent lamp fixture apparatus of claim 1, where the high frequency high potential wires are connected to lampholders for parallel connection of the fluorescent tube lamps.

12. The fluorescent lamp fixture apparatus of claim 1, where the high frequency high potential wires are connected to lampholders for series connection of all the fluorescent tube lamps.

13. A method of wiring a fluorescent lamp fixture apparatus to drive one or more pairs of fluorescent tube lamps, the method comprising:

locating a first end of a ballast proximate a center of a fixture having first and second longitudinal fixture ends;

connecting a plurality of high frequency high potential wires extending from the first ballast end directly to inner lampholders proximate the fixture center; and connecting low frequency low potential wires extending from a housing of the ballast to outer lampholders proximate the fixture ends.

14. The method of claim 13, where connecting the low frequency low potential wires comprises:

creating first and second low frequency low potential wiring runs individually including at least two wires connected to the low frequency low potential wires, the low frequency low potential wiring runs individually extending toward corresponding ones of the first and second fixture ends; and connecting wires of the first and second low frequency low potential wiring runs to the outer lampholders proximate the fixture ends.

15. The method of claim 14, where connecting the low frequency low potential wires further comprises:

connecting at least two multi-tap connectors to the low frequency low potential wires proximate the fixture center;

connecting the first low frequency low potential wiring run to the multi-tap connectors; and connecting the second low frequency low potential wiring run to the multi-tap connectors.

16. The method of claim 15, where creating first and second low frequency low potential wiring runs comprises making the first and second low frequency low potential wiring runs of approximately equal length.

17. The method of claim 14, where creating first and second low frequency low potential wiring runs comprises making the first and second low frequency low potential wiring runs of approximately equal length.

18. The method of claim 14, where connecting the high frequency high potential wires comprises connecting the high frequency high potential wires to lampholders for parallel connection of the fluorescent tube lamps.

19. The method of claim 14, where connecting the high frequency high potential wires comprises connecting the high frequency high potential wires to lampholders for series connection of all the fluorescent tube lamps.

* * * * *